US008905497B2

(12) United States Patent
Bantle

(10) Patent No.: US 8,905,497 B2
(45) Date of Patent: Dec. 9, 2014

(54) SLIDING ARRANGEMENT

(75) Inventor: Ulrich Bantle, Empfingen (DE)

(73) Assignee: Karl Simon GmbH & Co. KG (DE)

( * ) Notice: Subject to any disclaimer, the term of this patent is extended or adjusted under 35 U.S.C. 154(b) by 242 days.

(21) Appl. No.: 13/500,337

(22) PCT Filed: Oct. 14, 2010

(86) PCT No.: PCT/EP2010/065390
§ 371 (c)(1),
(2), (4) Date: Jun. 19, 2012

(87) PCT Pub. No.: WO2011/045362
PCT Pub. Date: Apr. 21, 2011

(65) Prior Publication Data

US 2012/0272478 A1 Nov. 1, 2012

(51) Int. Cl.
*A47B 95/02* (2006.01)
*A47B 88/04* (2006.01)

(52) U.S. Cl.
CPC ..... *A47B 88/0477* (2013.01); *A47B 88/0481* (2013.01)
USPC ..... 312/319.1; 312/333; 267/150

(58) Field of Classification Search
USPC ..... 267/150, 248; 188/284; 312/333, 319.1, 312/334.44, 334.47; 16/197, 72
See application file for complete search history.

(56) References Cited

U.S. PATENT DOCUMENTS

| | | | | |
|---|---|---|---|---|
| 2,048,418 | A * | 7/1936 | Warren | 267/34 |
| 2,421,595 | A * | 6/1947 | Brown | 16/66 |
| 2,666,944 | A * | 1/1954 | Stehlin | 16/70 |
| 3,831,919 | A * | 8/1974 | Nicholls | 267/34 |
| 3,913,901 | A * | 10/1975 | Molders | 267/34 |
| 5,364,179 | A * | 11/1994 | Brustle et al. | 312/333 |
| 6,736,471 | B2 * | 5/2004 | Lin | 312/333 |
| 6,997,528 | B2 * | 2/2006 | Yang | 312/333 |
| 7,374,260 | B2 * | 5/2008 | Lu | 312/333 |
| 7,533,946 | B2 * | 5/2009 | Hoffman | 312/333 |
| 7,748,800 | B2 * | 7/2010 | Compagnucci | 312/333 |
| 7,854,485 | B2 * | 12/2010 | Berger | 312/333 |
| 8,240,787 | B2 * | 8/2012 | Chen et al. | 312/333 |
| 2007/0132346 | A1 | 6/2007 | Huang | |

FOREIGN PATENT DOCUMENTS

| | | | |
|---|---|---|---|
| DE | 10008350 | A1 | 9/2001 |
| DE | 202004000840 | U1 | 2/2005 |
| DE | 202004019738 | U1 | 3/2005 |
| DE | 102007008688 | A1 | 8/2008 |
| JP | 2005230468 | A * | 9/2005 |
| WO | 2007111424 | A1 | 10/2007 |
| WO | 2008101582 | A2 | 8/2008 |

* cited by examiner

*Primary Examiner* — Thomas J Williams
*Assistant Examiner* — Mariano Sy
(74) *Attorney, Agent, or Firm* — Waddey & Patterson, P.C.; Lucian Wayne Beavers

(57) ABSTRACT

A sliding arrangement, in particular an extension apparatus for drawers, sliding doors, hinged doors, etc., has an extending arrangement which comprises a sliding piece (21) that is displaceable by means of a spring element (22) between an inserted position and an extended position. In order to enable user-friendly opening of the drawer, provision is made according to the present invention that the sliding piece is displaceable over a first displacement distance in spring-impinged fashion, and in an adjacent second displacement distance is displaceable without spring impingement in a free-running portion of the extension apparatus.

18 Claims, 10 Drawing Sheets

SLIDING ARRANGEMENT

BACKGROUND OF THE INVENTION

1. Field of the Invention

The invention relates to a sliding arrangement, in particular an extension apparatus for drawers, sliding doors, hinged doors, etc., having an extending arrangement which comprises a sliding piece that is displaceable by means of a spring element between an inserted position and an extended position.

The invention further relates to a method for operating a drawer.

2. Description of the Prior Art

DE 10 2007 008 688 A1 discloses a retraction apparatus for drawers. It comprises a spring-impinged coupling piece that is movable upon displacement of the drawer between a retracted position and a pulled-out position. The coupling piece is embodied in this context as a tilting segment that is moved by a follower that is installed on the drawer. When the tilting segment has reached the pulled-out position it releases the follower, and the drawer can be pulled out further in free-running mode, uninfluenced by the retraction apparatus. When the drawer is closed again, it can be displaced in free-running mode until the follower is captured by the tilting segment.

The previously tensioned spring then pulls the drawer into the closed position. To prevent a hard impact by the drawer in this context, the retraction motion is decelerated with a damper.

Handleless drawers are becoming increasingly desirable for reasons of design. Such drawers cannot always easily be opened with the known retraction apparatuses, since the drawer is held in the closed position by the action of the spring.

Also known from the existing art are extension apparatuses for drawers. These comprise an extending arrangement that, after unlatching thereof, move the drawer from a closed position into a partly open position. In this operation, a spring is discharged in order to make the motion energy available. When the extension operation controlled by the spring is complete, the drawer can be grasped and completely opened. The spring is then tensioned again upon closing of the drawer. The spring must thus be configured so that it guarantees a sufficiently long extension travel so that the drawer can be conveniently grasped. The springs necessary for this, having a long spring travel, have the disadvantage that a great deal of energy must be introduced by the user into the spring in order to tension the spring upon closing of the drawer. This is, however, perceived as bothersome, since a counter-force must be overcome over a large portion of the closing distance.

SUMMARY OF THE INVENTION

It is an object of the invention to improve operator convenience in the context of a drawer or other sliding element.

This object is achieved in that the sliding piece is displaceable over a first displacement distance in spring-impinged fashion, and in an adjacent second displacement distance is displaceable without spring impingement in a free-running portion of the extension apparatus.

According to the present invention the overall ejection travel made available by the sliding arrangement is thus divided into two displacement distances. In the region of the first displacement distance, the spring element is effective. This accelerates the sliding piece and thus the coupled drawer within this first partial distance. The result is that a kinetic energy is introduced into the drawer and the sliding piece, which energy moves the drawer and the sliding piece in the region of the second displacement travel. After the second displacement distance has been traveled, the drawer is sufficiently open that it can be conveniently grasped and completely pulled out. Advantageously, the drawer travels against a stop at the end of the second displacement distance, so that a defined partly open position is achieved.

Upon closing of the drawer, only the relatively short spring travel of the spring element needs to be overcome; in accordance with the formula $U=(c*x^2)/2$ (U=energy, c=spring constant, x=spring travel), relatively little energy is necessary. The present invention thus takes account of the fact that the required closure energy scales as the square of the spring travel, which should therefore, in accordance with the invention, be kept low.

The ejection force, on the other hand, is calculated using the formula $F=c*x$. Here the spring constant c should be selected so that for a small ejection distance, the resulting force (F) is sufficient to accelerate the drawer and guide it through the second displacement distance.

According to a preferred configuration of the invention, provision can be made that the combined total displacement distance, made up of the first and the second displacement distance, is equal to at least 60 mm, by preference ≥70 mm. It is then possible, with usual drawer embodiments, to conveniently reach behind the drawer front and pull the drawer completely out. This is advantageous in particular with handleless drawer fronts. Advantageously, the sliding arrangement according to the present invention is dimensioned so that the energy of motion introduced into the sliding piece by means of the spring element is so great that the sliding piece travels automatically to the end of the second displacement distance.

A sliding arrangement according to the present invention can be characterized in that the spring element is held in a pre-tensioned position at a stop at the end of the first displacement distance. This further shortens the theoretically available spring travel of the spring element, thereby appreciably decreasing the energy needed to load the spring. At the same time, however, the quantity of available energy provided by the spring element with the drawer in the closed position remains unchanged.

A particularly preferred inventive configuration is such that a coupling piece is indirectly or directly coupled to the extending arrangement, the coupling piece being displaceable by means of a spring between a retracted position and a pulled-out position. With this embodiment, the extension apparatus is combined with a retraction apparatus. To open the drawer, firstly the extending apparatus is triggered and, by means of the spring element, traverses the first displacement distance in positively controlled fashion. The sliding piece then travels passively through the second displacement distance. At the end of the second displacement distance, the coupling piece can then be moved against the force of the spring out of the retracted position into the pulled-out position. The spring is then available later, upon closing of the drawer, in order to pull the drawer into the closed position. If the embodiment is such that the sliding piece still has residual kinetic energy at the end of the second travel distance, that energy can then also be transferred, for example, into the coupling piece; the result is that the spring is already moved into a partly pre-tensioned position, which ergonomically optimizes the drawer opening operation.

A controlled closing motion can be achieved by the fact that a damper damps the motion of the coupling piece from the pulled-out position into the retracted position.

A preferred variant embodiment of the invention can be characterized in that in the pulled-out position, the coupling piece is held by means of a positioning arrangement in a parked position; and that in the parked position, the sliding piece is displaceable relative to the coupling piece. The result is that the retraction apparatus has a simple construction, and that the operating sequence of the retraction apparatus can advantageously be integrated into the motion sequence of the drawer.

A simple and economical construction for a retraction apparatus according to the present invention is produced if provision is made that the extending arrangement is held by means of the spring element in the inserted position in pre-tensioned fashion. Upon actuation of the extending arrangement when the drawer is in the closed position, the spring element can transfer its spring energy to the sliding piece. The drawer is thereby brought into the partly opened position.

A particularly preferred inventive configuration can be characterized in that the extending arrangement comprises an overtravel mechanism to disengage the inserted position. The retraction apparatus can thereby be handled in particularly user-friendly fashion. To trigger the extending arrangement it is possible, depending on the design of the drawer, for example to operate the overtravel mechanism by simply pushing the drawer front.

If provision is made that the extending arrangement comprises a carrier, and that a control element, in particular a latch, which enables a displacement of the sliding piece relative to the carrier, is effective upon a displacement of the sliding piece from the extension position into the insertion position, a triggered extending arrangement can then be reloaded in simple fashion.

In order to prevent inadvertent triggering of the extending arrangement, one inventive variant is such that the sliding piece is secured in the inserted position by means of an immobilizing piece.

A preferred variant embodiment of the invention is such that a control element of the extending arrangement locks, upon closure of the drawer, against an enclosure-mounted blocking element upon a displacement of the extending arrangement from the extended position into the insertion position.

Reliable operation of the retraction apparatus is guaranteed by the fact that the control element secures the insertion position of the extending arrangement at least in sub-regions of the displacement, effected by the spring, of the coupling piece.

Actuation of the extending arrangement occurs easily thanks to the fact that the control element is displaceable out of the retracted position toward a holding piece in order to unlatch the extending arrangement.

The object of the invention is also achieved with a method for operating a drawer or the like, such that with the drawer in the closed position, an extending arrangement is triggered which moves the drawer out of the closed position into a partly open position, such that in a first travel distance the drawer is accelerated by means of a spring element of an extending arrangement; and that subsequently to the first travel distance, in a second travel distance the drawer is moved in a free-running portion (F) of the extending arrangement.

Here again, the extending arrangement serves for convenient opening of the drawer from the closed position.

If the invention is such that the drawer is pulled out of the partly open position, and this pulling motion is used to tension a spring, the spring tension can later, in the context of the closing operation, pull the drawer into the closed position.

This sequence can be implemented particularly conveniently by the fact that during opening of the drawer from the partly open position, a coupling piece is brought out of a retracted position into a pulled-out position; and that upon reaching the pulled-out position, the coupling piece is brought into a parked position and the coupling between the extending arrangement and the coupling piece is disengaged.

Operating convenience, especially for handleless drawers, etc., is high if provision is made that an overtravel mechanism is actuated in order to release the extending arrangement from the closed position.

If provision is made that upon a motion of the drawer out of an opened or partly opened position toward the closed position, firstly the extending arrangement is displaced in its free-running portion (F) and then the spring element of the extending arrangement is tensioned in order to move the sliding piece from the extension position into the inserted position, the extending arrangement is then brought into the insertion position upon closing of the drawer, so that this operation becomes integrated into the "natural" motion sequence of the drawer, this being perceived as particularly user-friendly.

For a smooth closing operation, provision can be made that the extending arrangement is pulled by means of the spring into the closed position of the drawer, and at the same time is decelerated by means of a damper.

To tension the extending arrangement, provision can be made that upon closing of the drawer etc., the extending arrangement is moved with a control element onto a blocking element. This enables a low part complexity.

It is advantageous in this context that the blocking element is moved onto the blocking element in the interior of the enclosure. This enables reliable operation and protected accommodation of the actuation point. A further result is operation that is clearly defined and readily understandable by the user.

One inventive variant is such that the extending arrangement is brought from the extension position into the insertion position immediately before the coupling piece is pulled in with the spring.

The invention will be explained in further detail below with reference to an exemplifying embodiment depicted in the drawings, in which:

DETAILED DESCRIPTION

Figure 1:
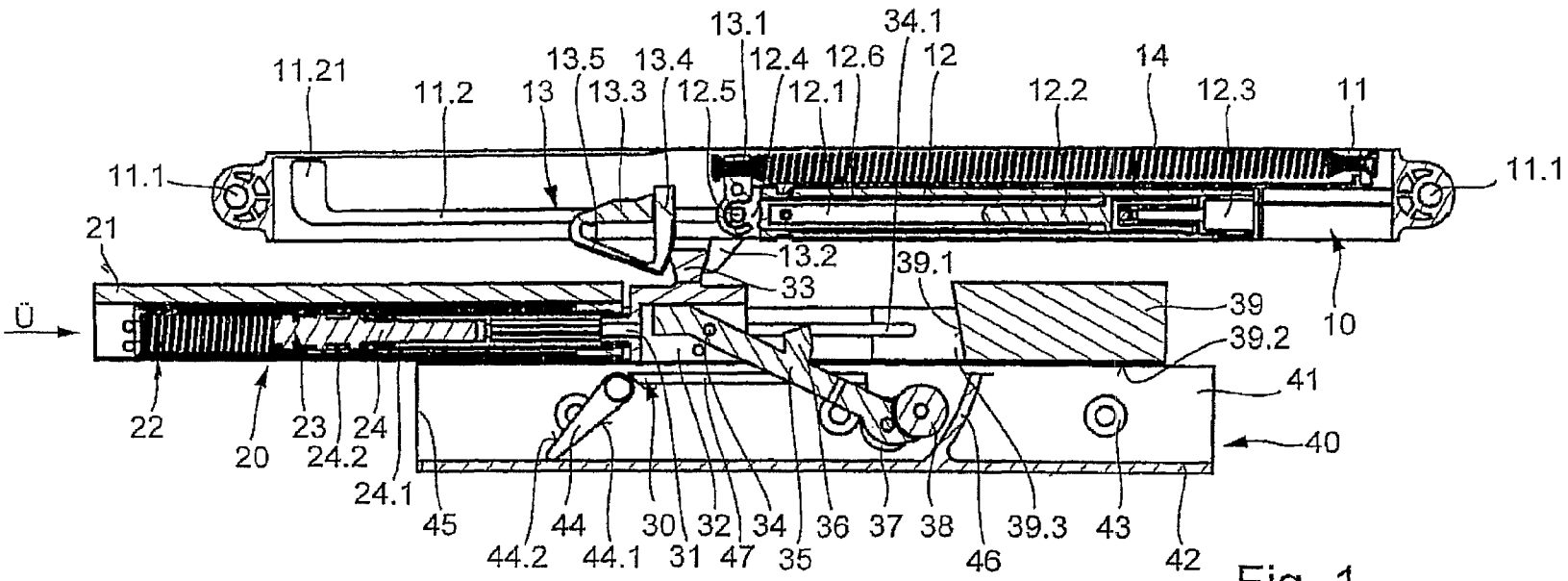
FIGS. 1 to 10 are side views of a retraction apparatus, partly in section and in various operating positions.

FIG. 1 shows a retraction apparatus such as the one used, for example, in drawers. Utilization in other components to be moved, such as doors, hatches, etc., is also conceivable. The retraction apparatus encompasses a base part 40 and a housing 10, each of which is mountable on a housing enclosure (not depicted). Also provided is an extending arrangement 20 that is arranged on a drawer (likewise not depicted).

Housing 10 is equipped with screw receptacles 11.1 that make possible enclosure-side mounting. Housing 10 has two side walls 11, spaced in parallel fashion apart from one another, into which guides 11.2 are recessed. Guides 11.2 comprise a slot-shaped aperture that opens into a widened recess 11.21. Guides 11.2 of the two side walls 11 align with one another.

A damper 12 is accommodated in housing 10. Damper 12 is embodied as a fluid damper, in the present case as an air damper. The use of an air damper has the advantage that in the event of damage, liquid cannot emerge and contaminate the drawer contents. Damper 12 comprises a cylinder 12.6 in which a piston 12.2 is pulled out starting from the inserted position shown in FIG. 1. In the context of the return motion of piston 12.2, it works against an air cushion, the air pressure being continuously dissipated. For this purpose, a small opening is present in an insert 12.3, through which opening the compressed air can escape in controlled fashion. At its end facing away from insert 12.3, piston rod 12.1 possesses a head segment 12.4 that forms a pivot bearing 12.5. A coupling piece 13 in the form of a tilting element is held pivotably on pivot bearing 12.5. The pivoting motion proceeds around a pivot axis extending perpendicular to the image plane in accordance with FIG. 2. A spring holder 13.1, which holds one end of a spring 14, is arranged on coupling piece 13. The other end of spring 14 is suspended on the housing side.

Coupling piece 13 possesses a trigger 13.2 that is arranged at a distance from the pivot axis. Also present on coupling piece 13 is a follower 13.4 that is shaped via a spring element 13.5 on an arm 13.3. A connecting part 30 of an extending arrangement 20 is detachably connectable to follower 13.4.

Extending arrangement 20 encompasses connecting part 30, the purpose of which is to create the detachable coupling to coupling piece 13. For this, connecting piece 30 has, on a holder 32, a latch 33 that can be coupled in the region between trigger 13.2 and follower 13.4. Holder 32 further carries, by means of a pivot bearing point 34, a control element 35 in the form of a lever. At its free end facing away from holder 32, control element 35 is fitted with a rotatable track roller 37 and a rotatable locking roller 38. A stop 36 is shaped on between pivot bearing point 34 and locking roller 38. A carrier 31 adjoins holder 32.

A plunger 24 is held via a threaded connection on carrier 31 at the end facing away from holder 32. For this, plunger 24 is screwed with an external thread 24.1 into a threaded receptacle of carrier 31. Plunger 24 carries a snap-lock ring 24.2. The latter is held, freely rotatably in a circumferential direction, in a bearing receptacle of plunger 24. Snap-lock ring 24.2 comprises a snap-lock element that is guided in a control cam 23 of a hollow cylinder of a sliding piece 21.

Control cam 23 is recessed, in the form of a groove, into the inner wall of sliding piece 21. Control cam 23 and snap-lock ring 24.2 of plunger 24 form an overtravel mechanism. The mode of operation in this context is similar to that in a ball-point pen, plunger 24 constituting the pushbutton of the ball-point pen. A spring element 22 in the form of a helical spring is inserted into sliding piece 21 and is secured against the walls of the hollow cylinder to prevent buckling.

Holder 32 is guided, with a hinge pin constituting pivot bearing 34, displaceably in a linear guide 34.1. The wall constituting linear guide 34.1 carries a shaped element 39 that constitutes a countersurface 39.1 and a running surface 39.2. Base part 40 is U-shaped in cross section. It comprises a mounting segment 41 having bores 43 for bolting to a furniture enclosure. A partition 42 adjoins mounting segment 41 perpendicularly. Partition 42, mounting segment 41, and a further partition parallel to the latter carry a shaped-on, obliquely oriented blocking surface 46 as well as a holding piece 47. In addition, a blocking element 44 is articulated pivotably on mounting segment 41 and is held, by gravity and/or by a spring element, in the initial position shown in FIG. 1. Blocking element 44 comprises two oppositely oriented control cams 44.1, 44.2.

The mode of operation of the retraction apparatus according to the present invention will be explained in further detail below with reference to FIGS. 1 to 10.

FIG. 1 shows the initial position of the retraction apparatus, i.e. the position in which the drawer is located when closed. This represents the position in which coupling piece 13 is in the retracted position. The overtravel mechanism is in a snap-lock position, snap-lock ring 24.2 being locked against a snap-lock projection of control cam 23. Blocking element 35 is held by means of a stop 35.1 on holder 32 in an elevated unlatched position. To release the overtravel mechanism, an overtravel Ü is introduced into, for example, the drawer front in the direction of the actual drawer closing motion. This overtravel Ü is introduced via a sliding piece 21 bolted to the drawer. In this context, sliding piece 21 shifts a small amount farther, against the pre-tension of spring element 22, in the direction of overtravel Ü with respect to plunger 24. As a result, the snap-locked position of snap-lock ring 24.2 in control cam 23 is disengaged, and snap-lock ring 24.2 is rotated in a circumferential direction until it arrives in a linear segment of control cam 23. To allow overtravel Ü to be carried out, latch 33 is braced against trigger 13.2.

Figure 2:
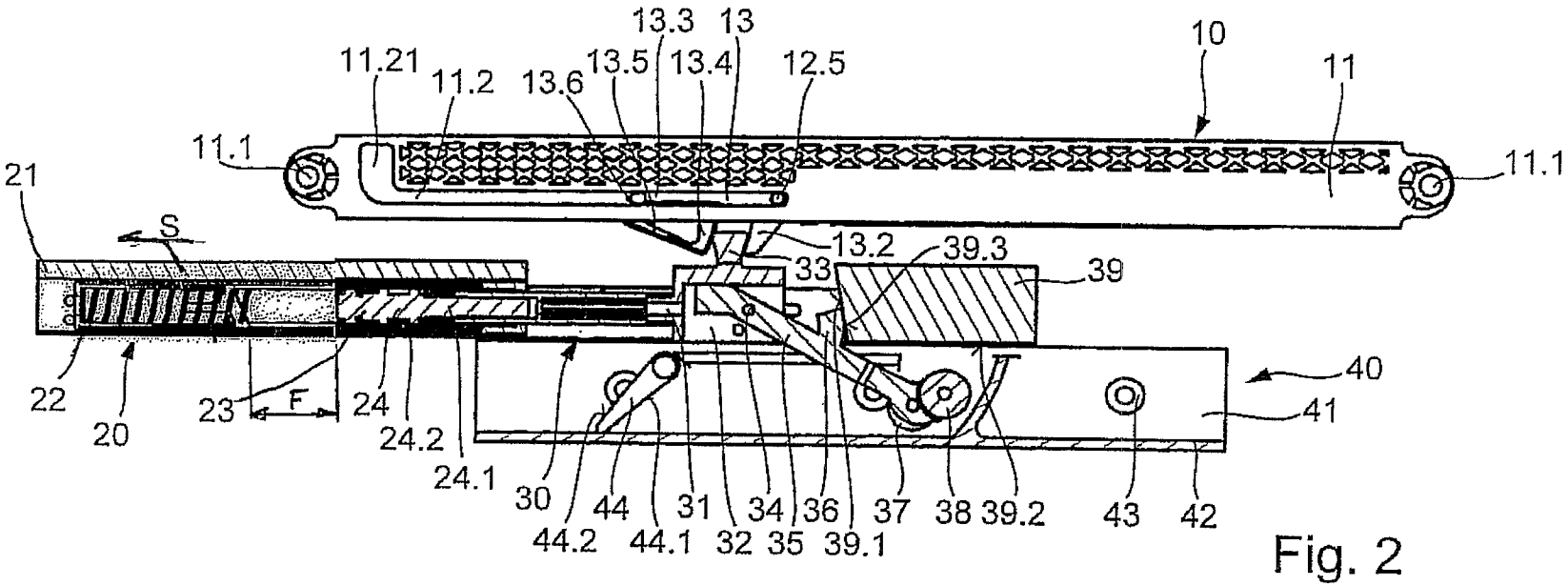
Figure 3:
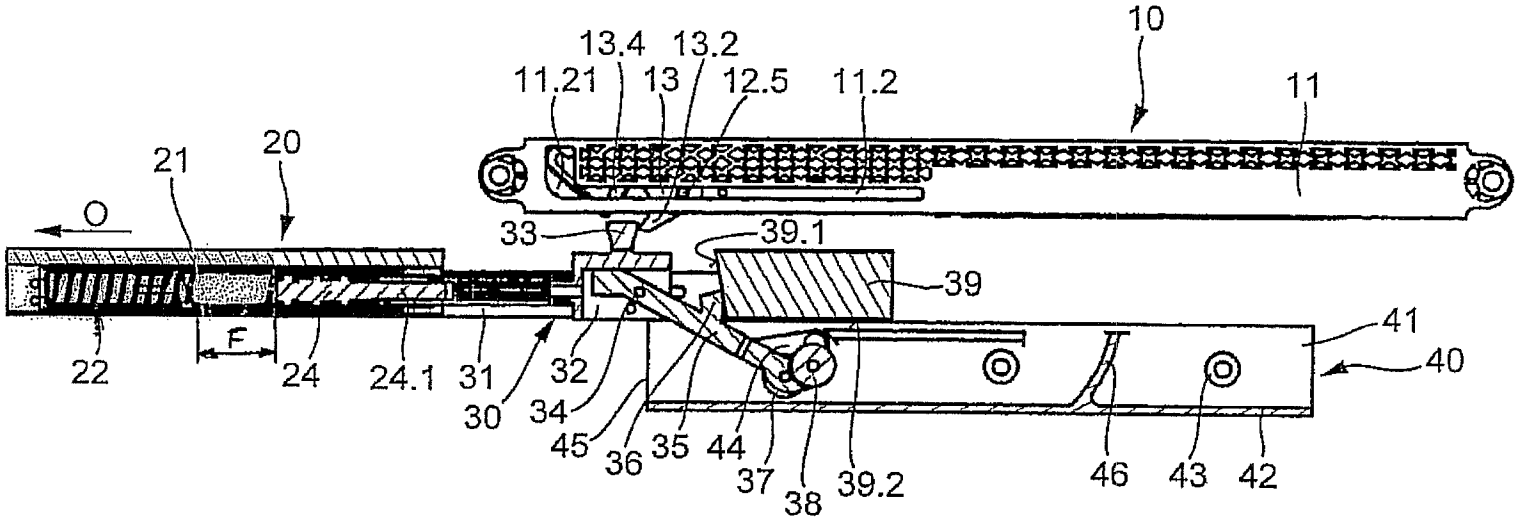

Once the drawer has been pushed and unloaded, sliding piece 21 is brought, as a result of the released snap-lock connection between snap-lock ring 24.2 and control cam 23, out of its inserted position (FIG. 1) into the extended position (FIG. 2). This displacement S is brought about by spring element 22, which holds sliding piece 21 under pre-tension in the inserted position. The total displacement distance traveled by sliding piece 21 in this context is subdivided into a first displacement distance and a second displacement distance.

Within the first displacement distance, spring element 22 is effective. It is braced at its one end against sliding piece 21 and at its other end with respect to plunger 24. Once plunger 24 has been unlatched by means of overtravel mechanism U, spring element 22 can slacken, sliding piece 21 being guided through the first displacement distance in response to spring element 22. At the end of the first displacement distance, spring element 22 is in its completely slackened state. This is then followed by the second displacement distance as a free-running portion F. In this region, no spring force acts on sliding piece 21. Instead, the kinetic energy of sliding piece 21, generated in the first displacement distance, is utilized to travel through free-running portion F. At the end of the second displacement distance, the displacement motion of sliding piece 21 is limited with a stop. The stop couples sliding piece positively to plunger 24 in the direction of sliding motion S (according to FIG. 2). FIG. 2 shows the completely extended position of sliding piece 21 after the first and the second displacement distance have been traveled through. Because the drawer is coupled to sliding piece 21, it is partly opened in accordance with the displacement travel of the sliding piece.

Figure 4:
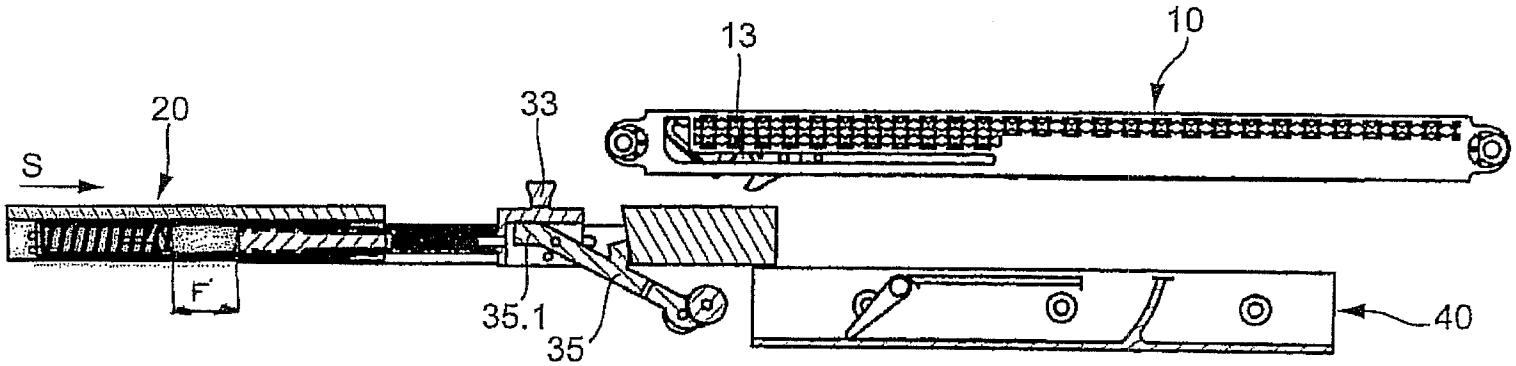

When the position shown in FIG. 2 has been reached, the drawer can be conveniently grasped and pulled manually into a further partly open position or completely into the open position. The extending arrangement coupled to the drawer is then, in this context, moved in opening direction Ö. Because coupling piece 13 is coupled, with latch 33, to extending arrangement 20, coupling piece 13 is also moved in opening direction Ö (see FIG. 3), coupling piece 13 being guided in guide 11.2. Coupling piece 13 entrains piston rod 12.1 of damper 12 and thus displaces piston 12.2. At the time, the spring is also tensioned. Coupling piece 13 is pulled by extraction apparatus 20 until follower 13.4, guided in guide 11.2, arrives in the region of recess 11.21. Because spring 14 acts eccentrically with respect to pivot axis 12.5, coupling piece 13 is tilted around pivot axis 12.5, and follower 13.4 drops into recess 11.21, in that context coming out of engagement with holder 32. Because the connection between extending arrangement 20 and coupling piece 13 is now disengaged, the drawer can be further pulled out in free-running mode, as FIG. 4 illustrates. In this context, track roller 37 also deflects blocking element 44 against its control cam 44.1 and lifts it upward against the direction of gravity. Track roller 37 moves past blocking element 44, and control element 35 departs from fitting base part 40 through opening 45.

FIG. 4 shows a further partly open position.

Figure 5:
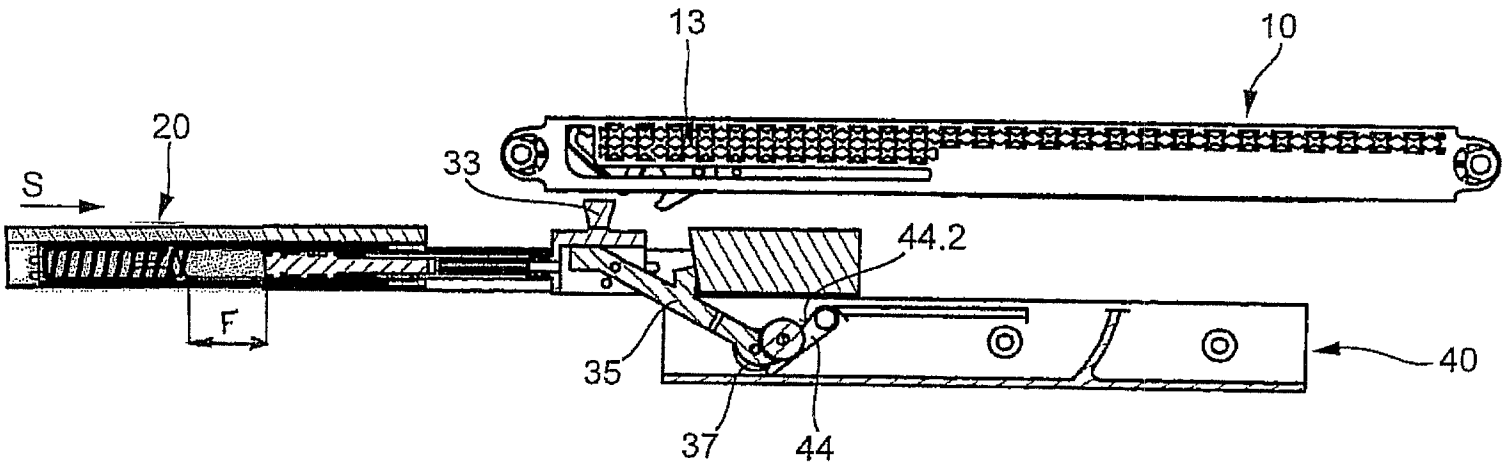
Figure 6:
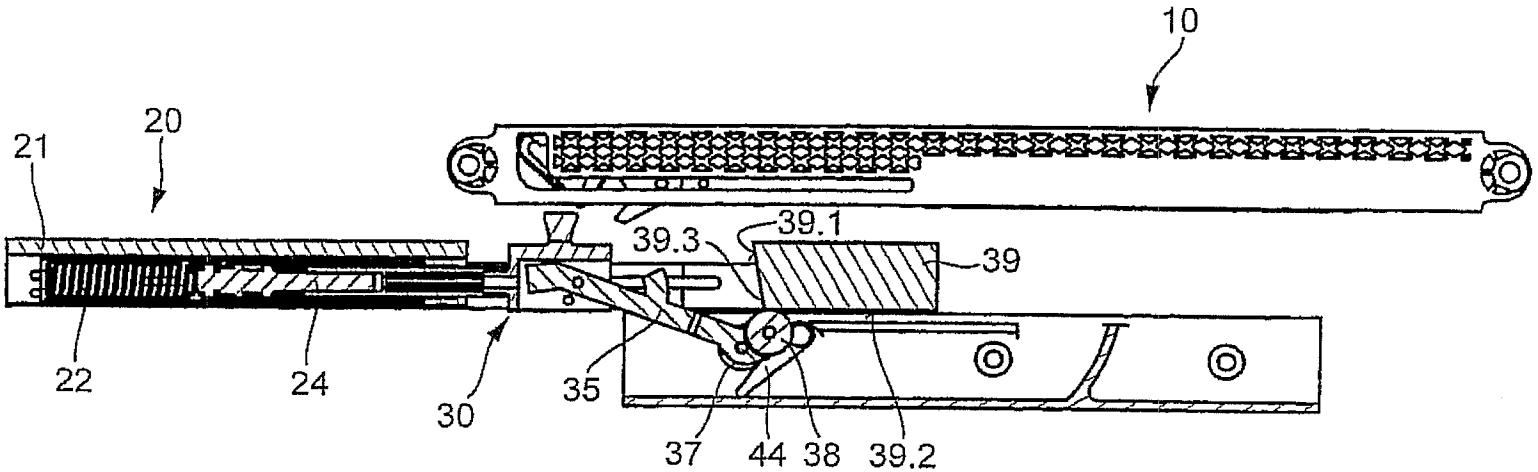

Upon closing of the drawer (closing direction S) and thus in the context of the transition of the retraction apparatus from FIG. 4 to FIG. 5, track roller 37 encounters control cam 44.2 of blocking element 44, which is blocked in this direction. The roller proceeds there against the direction of gravity until locking roller 38 encounters running surface 39.2, as shown by FIG. 6. Connecting part 30 can now be pushed no farther in closing direction S. Closing motion S now causes plunger 24 to become inserted into sliding piece 21; plunger 24 then firstly travels through free-running portion F, and spring element 22 is then tensioned until plunger 24 has arrived at its snap-locked position (snap-lock ring 24.2 and control cam 23). Extending arrangement 20 is then tensioned again, and is in its inserted position. In the course of this operation, locking roller 38 rolls on running surface 39.2 until, at the end of running surface 39.2, it travels over an edge 39.3 that conveys it into countersurface 39.1.

Figure 7:
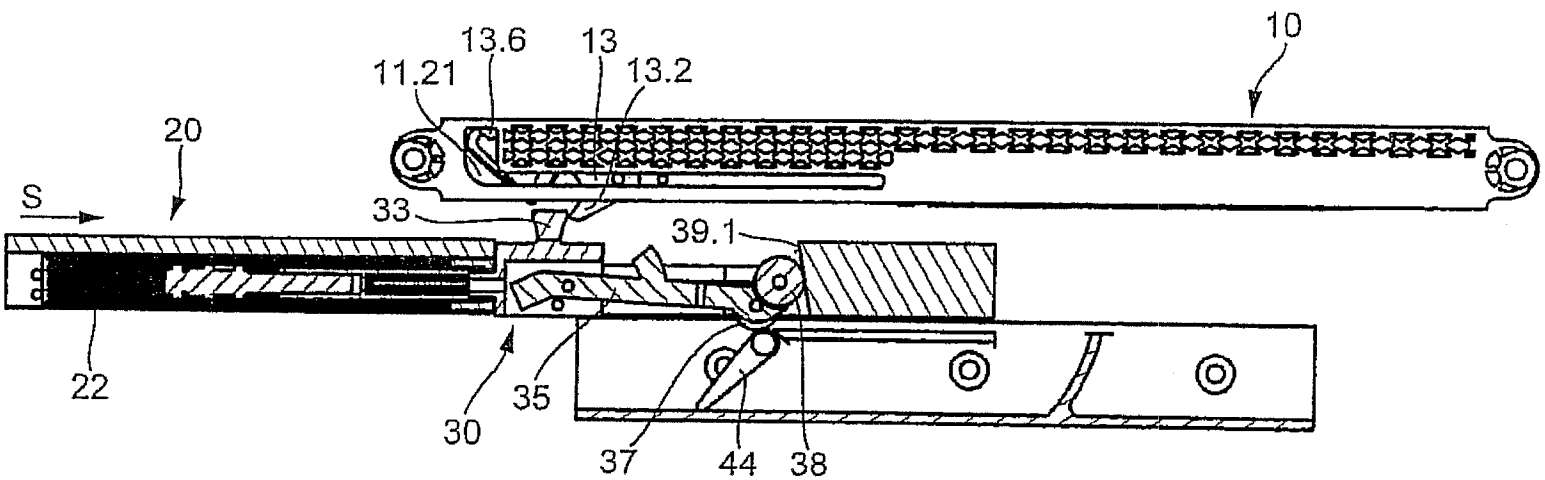
Figure 8:
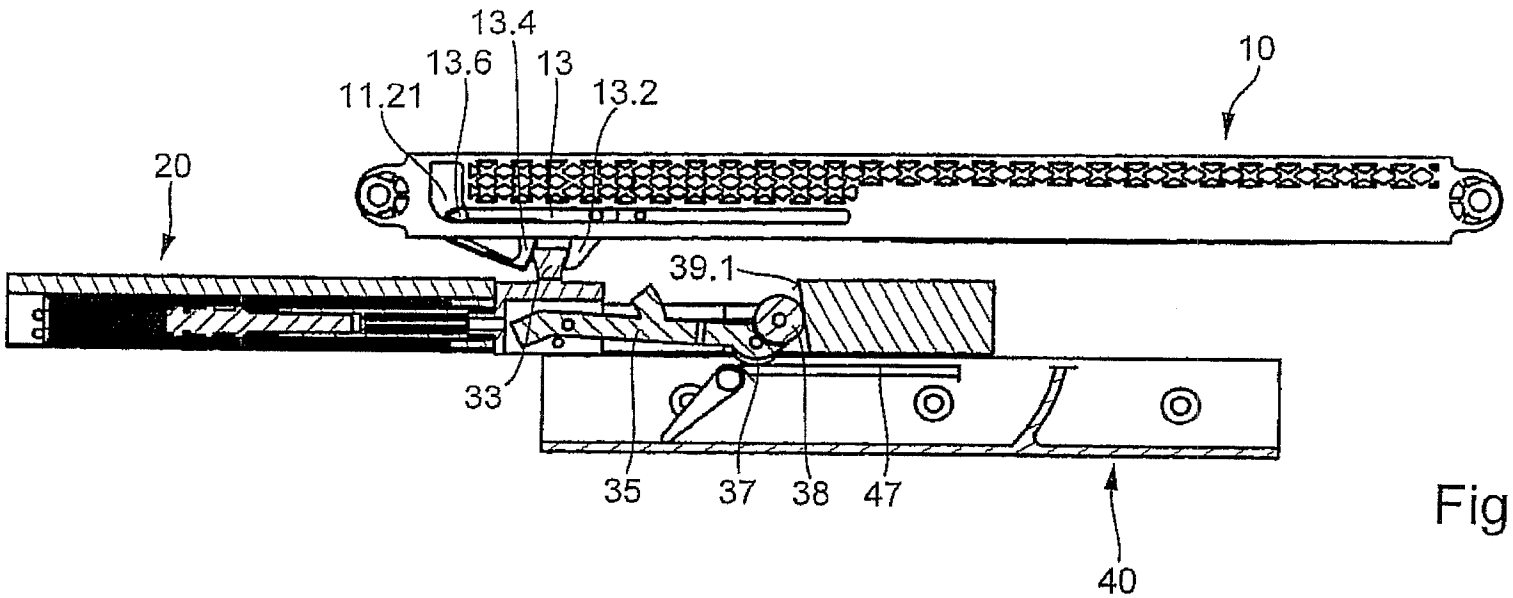
Figure 9:
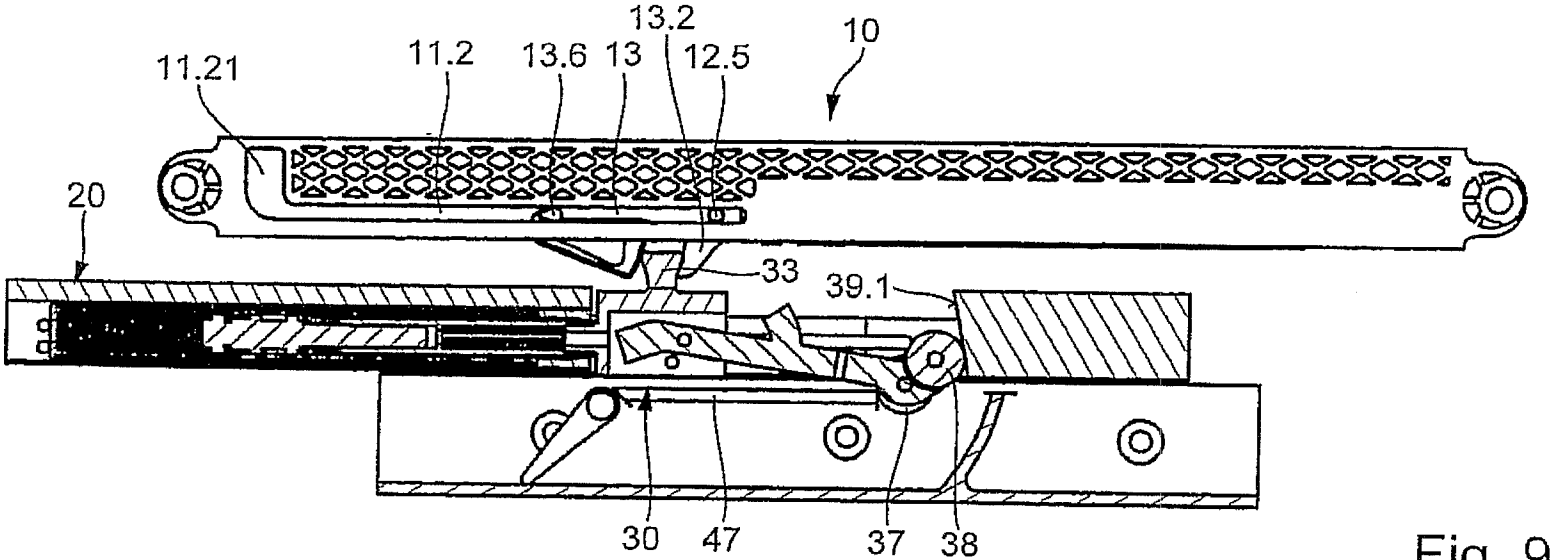

Control element 35 then, as shown in FIG. 7, pivots into its blocked position because of the fact that track roller 37 is continuing to run onto blocking element 44. Locking roller 38 abuts against countersurface 39.1 and blocks any inadvertent triggering of the extending arrangement out of the inserted position.

Figure 10:
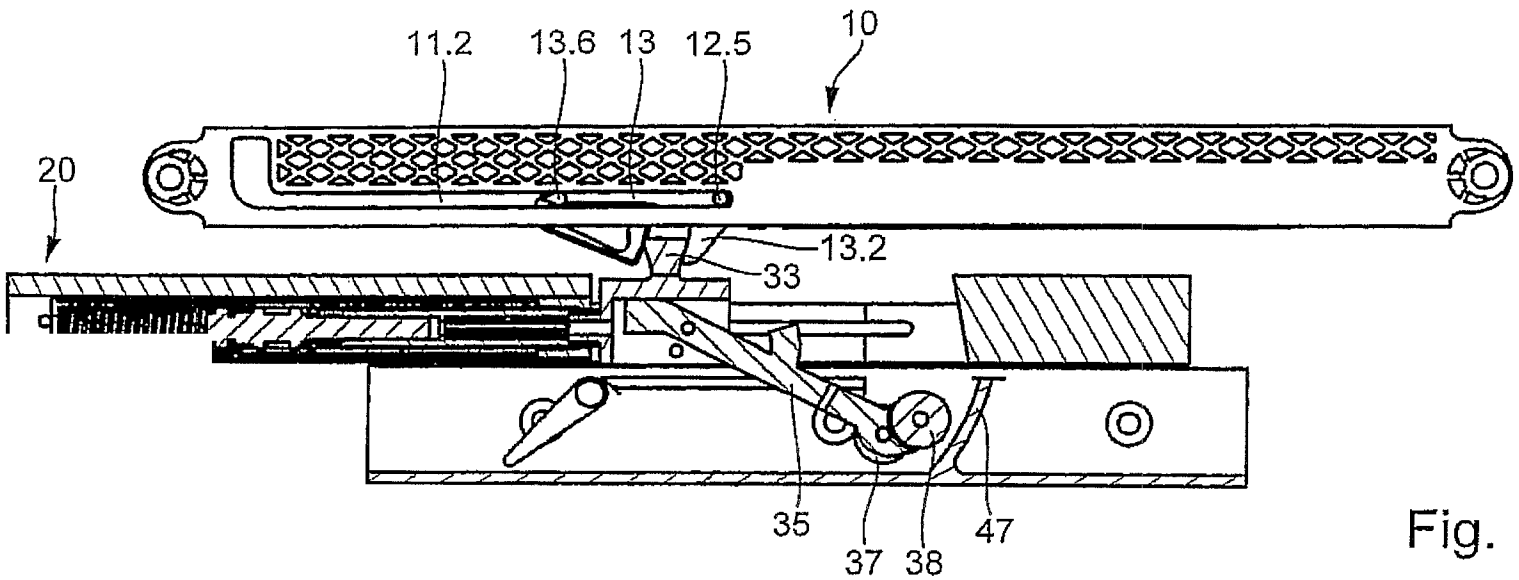

As FIG. 7 shows, immediately after extending arrangement 20 has been tensioned, latch 33 encounters trigger 13.2 and tilts it around pivot bearing 12.5. In that context, guide elements 13.6 are lifted out of recess 11.21 and coupling piece 13 is disengaged. Guide elements 13.6 then arrive in the region of guide 11.2, and spring 14 can pull coupling piece 13 back into the retracted position. Damper 12 damps this retraction motion. With the coupling piece, latch 33 is pulled against follower 13.4 (see FIG. 8); and the drawer is also automatically pulled, via sliding piece 21, into the closed position. In the context of this motion operation illustrated by FIGS. 8 and 9, track roller 37 travels over holding piece 47. With the drawer in the closed position, control element 35 drops, by gravity and/or by spring action, into the region below holding piece 47, as FIG. 10 shows. FIG. 10 is once again identical to FIG. 1, and shows the initial position in which the drawer is ready for another actuation.

Housing 10 and base part 40 are usually mounted on the furniture enclosure. It is also conceivable, however, to mount these parts on the drawer. Extending arrangement 20 is then also attached to the other respective furniture component.

The arrangement according to the present invention can be arranged laterally in the region of one or both of the drawer walls extending in the drawer motion direction. The retraction guide can also be part of the drawer's pulling-out guide. It can furthermore also be arranged centrally under the drawer bottom. Extending arrangement 20 is then, for example, held on the drawer front below the drawer bottom. Housing 10 is then arranged laterally on the furniture enclosure. Coupling of these components then takes place by incorporation of a crossmember or drawer as a connecting member.

References herein to a spring being "tensioned" may also be described as loading of the spring. This refers to the storing of potential energy in the spring and may include either tensile or compressive loading of the spring depending on the type of spring used.

The invention claimed is:

1. An extension apparatus, comprising:

an extending arrangement including an overtravel release mechanism, a sliding piece, and an extension spring, the extension spring arranged to displace the sliding piece from an inserted position toward an extended position, the extension spring biasing the sliding piece over a first displacement distance and the sliding piece being free-running over an adjacent second displacement distance without biasing of the extension spring, the overtravel release mechanism arranged to release the extension spring when the sliding piece is pushed inward past the inserted position.

2. The apparatus of claim 1, further comprising:

a stop arranged to limit the second displacement distance.

3. The apparatus of claim 1, wherein:

a combined total displacement distance made up of the first and second displacement distances is equal to at least 60 mm.

4. The apparatus of claim 3, wherein the combined total displacement distance is at least 75 mm.

5. The apparatus of claim 1, wherein:

the extension spring provides sufficient energy of motion to the sliding piece that the sliding piece travels automatically to the end of the second displacement distance.

6. The apparatus of claim 1, further comprising:

a retraction spring; and a coupling arranged to couple the extending arrangement to the retraction spring as the extending arrangement is moved from a pulled-out position toward a retracted position, the coupling and the extending arrangement being displaceable by the retraction spring to the retracted position.

7. The apparatus of claim 6, further comprising:

a damper arranged to dampen motion of the coupling and the extending arrangement toward the retracted position.

8. The apparatus of claim 1, wherein:

the extension spring and the sliding piece are arranged such that when the sliding piece is in the inserted position the extension spring is loaded.

9. The apparatus of claim 1, wherein the extending arrangement further includes:

a carrier, the sliding piece being slidable relative to the carrier; and a control element arranged to hold the carrier so that the sliding piece can be displaced inward relative to the carrier upon displacement of the sliding piece from the extended position into the inserted position.

10. The apparatus of claim 9, further comprising:

a retraction spring;

a coupling arranged to couple the extending arrangement to the retraction spring as the extending arrangement is moved from a pulled-out position toward a retracted position, the coupling and the extending arrangement being displaceable by the retraction spring to the retracted position;

a stop surface attached to the carrier; and wherein the control element is arranged such that after the sliding piece is displaced to the inserted position, and while the extending arrangement is being moved from the pulled-out position toward the retracted position by the retraction spring, the control element engages the stop surface to secure the extending arrangement in its inserted position and prevent premature triggering of the extension spring.

11. An extension apparatus comprising:

an extending arrangement including a sliding piece and an extension spring arranged to displace the sliding piece from an inserted position toward an extended position, the extension spring biasing the sliding piece over a first displacement distance and the sliding piece being free-running over an adjacent second displacement distance without biasing of the extension spring;

a retraction spring;

a coupling arranged to couple the extending arrangement to the retraction spring as the extending arrangement is moved from a pulled-out position toward a retracted position, the coupling and the extending arrangement being displaceable by the retraction spring to the retracted position; and a positioning arrangement including a guide in which the coupling is displaceable, the positioning arrangement defining a parked position of the coupling in which the coupling is disengaged from the sliding piece allowing the extending arrangement to be moved to the pulled out position.

12. A method of operating an extending arrangement for a structure, comprising:

triggering the extending arrangement, the triggering including actuating an overtravel mechanism to release the extending arrangement and the structure from the closed position;

accelerating the structure from a closed position with an extension spring of the extending arrangement as the structure moves through a first travel distance; and then allowing the structure to continue to freely run through a second travel distance to a partly open position without being further accelerated by the extension spring.

13. The method of claim 12, further comprising:

opening the structure from the partly open position to a fully open position;

during the opening, loading a retraction spring of a retraction apparatus for subsequent use in retracting the structure back to its closed position.

14. The method of claim 13, further comprising:

moving the structure back toward the closed position;

assisting the closing motion of the structure by retracting the structure back to its closed position with the retraction spring; and during the retracting, decelerating the structure with a damper.

15. The method of claim 14, further comprising:

during the moving of the structure back toward the closed position, moving the extending arrangement into an inserted position wherein the extension spring is reloaded, immediately before the retraction spring begins to assist the closing motion.

16. A method of operating an extending arrangement for a structure comprising:

triggering the extending arrangement;

accelerating the structure from a closed position with an extension spring of the extending arrangement as the structure moves through a first travel distance;

then allowing the structure to continue to freely run through a second travel distance to a partly open position without being further accelerated by the extension spring;

opening the structure from the partly open position to a fully open position;

during the opening of the structure from the partly open position, loading a retraction spring of a retraction apparatus for subsequent use in retracting the structure back to its closed position and moving a coupling piece associated with the retraction apparatus from a retracted position to a pulled-out position; and upon reaching the pulled-out position, moving the coupling piece to a parked position and disengaging the coupling piece and the retraction apparatus from the extending arrangement.

17. A method of operating an extending arrangement for a structure, comprising:

triggering the extending arrangement;

accelerating the structure from a closed position with an extension spring of the extending arrangement as the structure moves through a first travel distance;

then allowing the structure to continue to freely run through a second travel distance to a partly open position without being further accelerated by the extension spring; and moving the structure from an open or partly open position back to the closed position, and during the moving of the structure displacing a sliding piece of the extending arrangement in a free-running mode relative to the extension spring, and then reloading the extension spring as the sliding piece continues to move relative to the extension spring.

18. The method of claim 17, further comprising:

during the movement of the structure back to the closed position, engaging a control element of a blocking arrangement with a blocking element to hold the extension spring while the sliding piece moves relative to the extension spring to reload the extension spring.

* * * * *

UNITED STATES PATENT AND TRADEMARK OFFICE

CERTIFICATE OF CORRECTION

PATENT NO. : 8,905,497 B2
APPLICATION NO. : 13/500337
DATED : December 9, 2014
INVENTOR(S) : Ulrich Bantle It is certified that error appears in the above-identified patent and that said Letters Patent is hereby corrected as shown below:

In the Claims

Column 10, lines 40-41, Claim 17, delete "relative to the extension spring".

Signed and Sealed this
Twenty-third Day of June, 2015

Michelle K. Lee

Michelle K. Lee
*Director of the United States Patent and Trademark Office*